US005813483A

United States Patent [19]

Latham et al.

[11] Patent Number: 5,813,483

[45] Date of Patent: Sep. 29, 1998

[54] SAFETY DEVICE FOR USE ON DRILLING RIGS AND PROCESS OF RUNNING LARGE DIAMETER PIPE INTO A WELL

[76] Inventors: James A. Latham, 523 E. Ave. B, Robstown, Tex. 78380; Taylor W. Latham, 10612 Emmord Loop, Corpus Christi, Tex. 78410

[21] Appl. No.: 767,508

[22] Filed: Dec. 16, 1996

[51] Int. Cl.[6] ..... E21B 21/10; E21B 34/10; F16K 15/04

[52] U.S. Cl. ..... 175/218; 137/533.11; 166/328

[58] Field of Search ..... 166/85.4, 95.1, 166/97.1, 327, 328, 330, 332.2, 380, 382; 175/218, 216; 137/240, 519.5, 533.11

[56] References Cited

U.S. PATENT DOCUMENTS

| | | | |
|---|---|---|---|
| 873,661 | 12/1907 | Brooks . | |
| 2,056,418 | 10/1936 | Coberly | 166/328 X |
| 2,213,309 | 9/1940 | Fortune . | |
| 2,330,564 | 9/1943 | Dyer | 166/380 X |
| 2,717,649 | 9/1955 | Kolsky | 166/328 X |
| 2,751,022 | 6/1956 | Baker et al. | 166/328 X |
| 3,062,296 | 11/1962 | Brown | 166/327 X |
| 3,159,219 | 12/1964 | Scott | 166/328 X |
| 3,525,394 | 8/1970 | Pitts et al. | 166/327 |
| 4,049,015 | 9/1977 | Brown . | |
| 4,577,614 | 3/1986 | Schoeffler . | |
| 4,694,855 | 9/1987 | Cunningham . | |
| 5,086,802 | 2/1992 | Spears . | |

OTHER PUBLICATIONS

The Smalley Steel Spring Company of Wheeling, Illinois p. 21 of catalog.

The Smelley Steel Spring Company of Wheeling, Illinois pp. 4, 21, 25 and 36 of catalog.

*Primary Examiner*—Tamara L. Graysay
*Assistant Examiner*—Jong-Suk Lee
*Attorney, Agent, or Firm*—G. Turner Moller

[57] ABSTRACT

When running in a hydrocarbon well with a large diameter pipe, such as a liner or wash pipe, on the bottom of smaller diameter drill pipe, a safety sub is screwed into the box of a drill pipe stand by the derrickman. Any low pressure mud flowing upwardly in the drill pipe is diverted by the sub to a standpipe and then to the mud system of the drilling rig. In the event high pressure mud starts flowing in the drill pipe, the safety sub is tightened with a wrench and a valve is manipulated to stop upward flow in the drill pipe. The safety sub is partially dismantled, leaving the valve closed and suitable pressure lines are connected to the sub to kill the well. The valve includes a ball check which is normally held open and a mechanism manipulated to allow the ball check to close against a seat. After closing the valve, the ball check may be pumped downwardly into the well to allow a wire line tool to be run into the hole. This is accomplished by a retainer normally holding the ball check against downward movement in the drill pipe which expands in response to pumping into the safety sub.

28 Claims, 2 Drawing Sheets

SAFETY DEVICE FOR USE ON DRILLING RIGS AND PROCESS OF RUNNING LARGE DIAMETER PIPE INTO A WELL

This invention relates to a safety device used on rigs drilling hydrocarbon wells and more particularly to a safety device used when going in the hole with a large diameter pipe on the bottom of a smaller diameter pipe, such as drill pipe.

BACKGROUND OF THE INVENTION

When running drill pipe into a well bore under normal conditions, i.e. with a bit and string of drill collars on the bottom, there is no substantial tendency for drilling mud to flow excessively upwardly inside the drill pipe. When going in the hole with a liner, wash pipe or other large diameter pipe on the bottom of drill pipe, there is a striking tendency for drilling mud or other well contents to flow upwardly inside the drill pipe. This is very undesirable because a considerable amount of drilling mud gets on the rig floor and no one can work under such conditions. In addition, the mud tank volume calculator soon gets out of whack because of the volume of mud lost from the system.

Going in the hole with large pipe on the bottom of drill pipe discharges mud onto the floor because there is something of a funnel effect occurring. Consider pushing a funnel, large end down, into a bucket of water. The volume of liquid displaced by the O.D. of the large end of the funnel has a tendency to shoot up the I.D. of the small end.

There has evolved an implement and a technique to accommodate, in a rough fashion, this displaced drilling mud. When going in the hole, the derrickman screws a short nipple or pin into the box of the uppermost drill pipe stand. The pin has a flexible hose attached to it leading to a standpipe low on the derrick leg. This pin/hose assembly is suspended from the travelling block with a spring or other counterbalanced system so its effective weight, which must be manhandled by the derrickman, is relatively light.

The driller lowers the travelling block so the drill pipe stand is run into the hole. As the box of the drill pipe stand approaches the rig floor, one of the floor hands coils up the flexible hose to keep it out of the way, the slips are set on the drill pipe and any mud flowing upwardly in the drill pipe is allowed to discharge to the standpipe. If the well makes mud from the funnel effect, low pressure mud flows into the flexible hose and then into the standpipe where it is returned to the mud system. After any low pressure mud stops flowing, the floor hands unscrew the pin from the drill pipe. When the travelling block is raised by the driller, the pin/hose assembly goes along with it. The derrickman places the upper end of a drill pipe stand into the elevators and then screws the pin into the exposed box of the next drill pipe stand. It will be seen that the conventional pin/hose assembly returns low pressure mud from the funnel effect to the mud tank which keeps the mud off the derrick floor and keeps the mud tank volume calculator from getting out of balance. This system is somewhat awkward but it is much better than contending with a great deal of drilling mud on the rig floor.

Disclosures of some interest relative to this invention are found in U.S. Pat. Nos. 873,661; 2,213,309; 4,049,015; 4,577,614; 4,694,855 and 5,086,802.

SUMMARY OF THE INVENTION

There is another, more serious but much less common, problem that occurs when running into the hole with large diameter pipe on the bottom of drill pipe. If a gas bubble gets into the large diameter pipe, it increases in height as it rises inside the large pipe because of the decrease in hydrostatic pressure with decreasing depth. When the bubble reaches the relatively small I.D. drill pipe, the bubble gets very tall because of the difference between the I.D.'s of the large and small pipe plus the increase due to a reduction in hydrostatic pressure. This causes a large reduction in hydrostatic pressure below the bubble which, of course, may cause the well to kick or blow out. This means that wells are prone to kick or attempt to blow out when running a large diameter string of pipe into the hole on the bottom of a small I.D. string of drill pipe. This is very disconcerting because the last thing anyone wants to do is contend with a kick while trying to cement a liner in the hole or recover a fish. It is very easy for the liner or wash pipe assembly to become stuck in the hole because of conditions caused by the kick. This is very disappointing indeed.

In this invention, when running in the hole with a large diameter pipe on the end of drill pipe, a safety sub is screwed into the exposed box of a drill pipe stand by the derrickman. The drill pipe stand is lowered into the well. The safety sub of this invention, under low pressure flow conditions, directs drilling mud to a standpipe high on a derrick leg and ultimately to the mud system and accordingly provides the same mud saving features of the prior art. A check valve prevents back flow of low pressure drilling mud from the flexible hose. This allows the standpipe to be high in the derrick and frees one of the floor hands, who in the prior art technique, coiled up the flexible hose.

In addition, the safety sub includes a valve that may be manipulated by the floor hands to close off upward flow inside the drill pipe. When high pressure flow is sensed in the mud flow lines by the floor hands or the driller, the safety sub is first tightened by the floor hands with a wrench because the derrickman only screws the safety sub into the drill pipe box so it is handy, i.e. hand tight and not tightened with a wrench. Next, the valve is closed to stop upward flow in the drill pipe. The safety sub can be partially dismantled to remove the mud flow lines normally connected to the standpipe while the valve remains in place and closed. The regular mud hose or a connection to a pump truck is made to the safety sub and conventional steps taken to bring the well under control, such as pumping mud into the well to kill it. Preferably, the safety sub carries a wrench that is used to tighten the pin in the uppermost drill pipe stand.

In a preferred embodiment, the safety sub includes a ball type check valve that is normally held open, i.e. normally held away from a seat. Manipulating the safety sub withdraws the mechanism holding the ball away from its seat so the ball check closes. After the upper end of the safety sub is disassembled and a pressure hose connected thereto, mud is pumped into the safety sub and the ball check moves away from its seat thereby allowing downward flow into the well. Preferably, the ball check is normally constrained against downward movement by a releasable holding element. If it is desired to go in the hole with wire line equipment, the releasable retaining element is manipulated so the ball check can be pumped to the bottom of the hole. This provision is very desirable when, for example, the liner or drill pipe is stuck and one needs to locate and back off above the stuck point. The ball check is dislodged from its normal position, a free point indicator is run into the hole on a wire line and the stuck point is located, and then the pipe above the stuck point is shot off with a string shot or other suitable wire line mechanism.

It is an object of this invention to provide an improved safety device for use on drilling rigs, especially when running in the hole with a large diameter pipe on the bottom of small diameter pipe.

A more specific object of this invention is to provide a combined safety sub and mud saver used when running in the hole with a large diameter pipe on the bottom of a smaller diameter pipe.

A further object of this invention is to provide a safety sub including a normally open ball check which can be dislodged and pumped into the hole thereby clearing the safety sub and allowing a wire line device to be run into the well.

These and other objects and advantages of this description will become more apparent as this description proceeds, reference being made to the accompanying drawings and appended claims.

DETAILED DESCRIPTION

Figure 1:
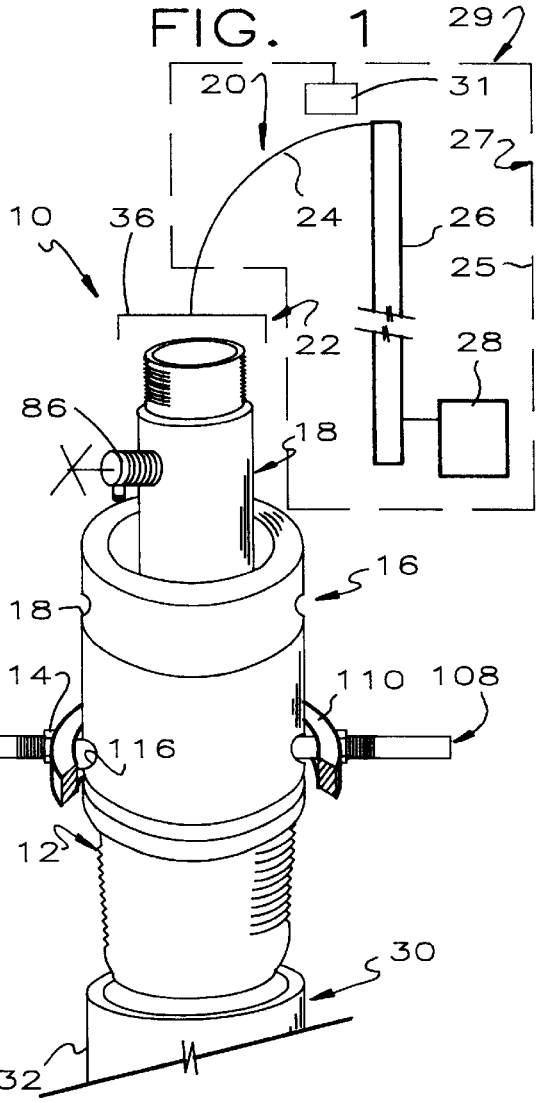
FIG. 1 is a partially pictorial and a partially broken isometric view of a safety sub of this invention, illustrated in a normal running position.

Referring to FIG. 1, a safety sub 10 of this invention comprises, as major components, a lower or valve section 12 providing a valve 14, an upper or operator section 16 for manipulating the valve 14, and a sleeve 18 directing well fluids exiting the well to a mud saving system 20.

The mud saving system 20 comprises a union 22 connected to the sleeve 18, a flexible hose 24 leading to a standpipe 26 mounted on one of the derrick legs 25 of the derrick 27 provided by a rig 29 having a travelling block 31. The standpipe 26 delivers any mud flowing upwardly out of the well due to the funnel effect to the rig mud system 28 and thereby prevents the mud tank volume calculator from getting out of whack. In addition, mud coming upwardly through a drill pipe string 30 attached to the safety sub 10 is directed to the mud system 28 rather than accumulating on the rig floor. Drill pipe has large coarse threaded connections on each end. Typically, the upper end of drill pipe is the female connection or box 32 and the lower end is the male connection or pin.

The standpipe 26 is preferably relatively high in the derrick so, when the safety sub 10 has been threaded into the box 32 of a conventional drill pipe stand, and the stand run into the hole and the slips (not shown) set, the flexible hose 24 extends at least partially up into the derrick and does not pile up on the derrick floor. The union 22 is a conventional easy-to-connect type including a coarse threaded union half 34 (FIG. 2) on the upper end of the safety sub and a mating union half 36 on the end of the hose 24. As used herein, a drill pipe stand is one or more drill pipe joints, and usually either two or three drill pipe joints, that have been threaded together and that have been standing in the derrick.

The lower or valve section 12 provides a cylindrical body 38 having a pin connection 40 threadably mating in the box 32 of an uppermost drill pipe joint. The body 38 includes an axial flow passage 41, a set of coarse internal drill pipe threads 42, and a central shoulder 44 providing a valve seat 46. The exterior of the body 38 will be recognized by those skilled in the art to be very similar to the exterior of a conventional drill pipe pin.

The valve 14 comprises a check valve including a ball check 48 provided in the lower end of the valve section 12 and constrained by a retaining means 50 received in a groove 52 provided by the lower valve section 12. Fluid flow is accordingly allowed in a downward direction into the well. As will be more fully pointed out hereinafter, the ball check 48 is normally held away from its seat 46 so upward flow through the axial flow path 41 is normally also allowed. As will be more fully apparent hereinafter, the retaining means 50 prevents the ball check 48 from moving downwardly into the well under normal conditions but allows the ball check 48 to be pumped downwardly into the well to clear the safety sub 10 and allow wire line operations through the lower valve section 12.

Figure 7:
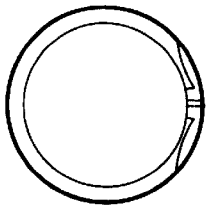
FIG. 7 (prior art)
FIG. 7 is an enlarged view of one of the retaining rings used in this invention.

Although the retaining means 50 may be a frangible retainer such as a shear pin extending across the end of the lower valve section 12 at a location below the ball check 48, the retaining means 50 is preferably at least one, and optimally two, expansible retaining rings of the type shown in FIG. 7. The expansible retaining ring has an inner unstressed diameter slightly smaller than the diameter of the ball check 48. The groove 52 is accordingly somewhat oversized to allow the expansible retaining ring to expand in response to the downward force, created by pump pressure, applied to the ball check 48 when it is desired to pump the ball check 48 into the well. An expansible retaining ring that may be used in the practice of this invention is known as a Model WHT-187 made by Smalley Steel Ring Company of Wheeling, Illinois. The expansible retaining rings are installed in a conventional manner, i.e. contracting the spring by inserting it into a tool having a conical or tapered opening in one end and then expelling the spring into the open end of the axial passage 41 and moving the spring until it enters the groove 52.

The operator section 16 is basically a thimble having coarse external drill pipe threads 54 mating with the threads 42. As will be pointed out more fully hereinafter, in a lowermost position of the operator section 16, the ball check 48 is held away from its seat 46. As the operator section 16 is unthreaded, the ball check 48 is allowed to close against the seat 46 thereby stopping flow upwardly out of the well. As will be more fully apparent hereinafter, the operator section 16 is capable of threading and unthreading movement relative to the lower valve section 12 for a predetermined axial distance, which in a preferred embodiment of the invention, is about one inch.

The sleeve 18 comprises a long tube or mandrel 56 mounted for rotation relative to the operator section 16. To this end, a bearing 58 abuts a shoulder 60 of the operator section 16 and a retaining ring 62. The bearing 58 also abuts a shoulder 64 provided by the mandrel 56. A threaded bearing nut 66 is threaded against the bottom of the bearing 58. It will accordingly be seen that the bearing 58 is captivated to the operator section 16 and to the mandrel 56.

Figure 3:
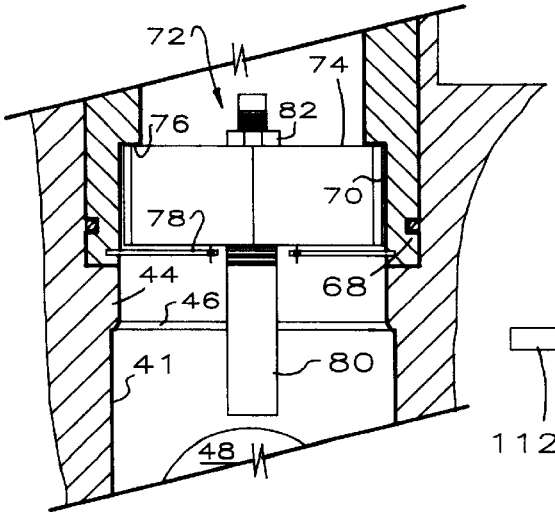
FIG. 3 is a further enlarged cross-sectional view of the mechanism holding the ball check in an open position.
Figure 2:
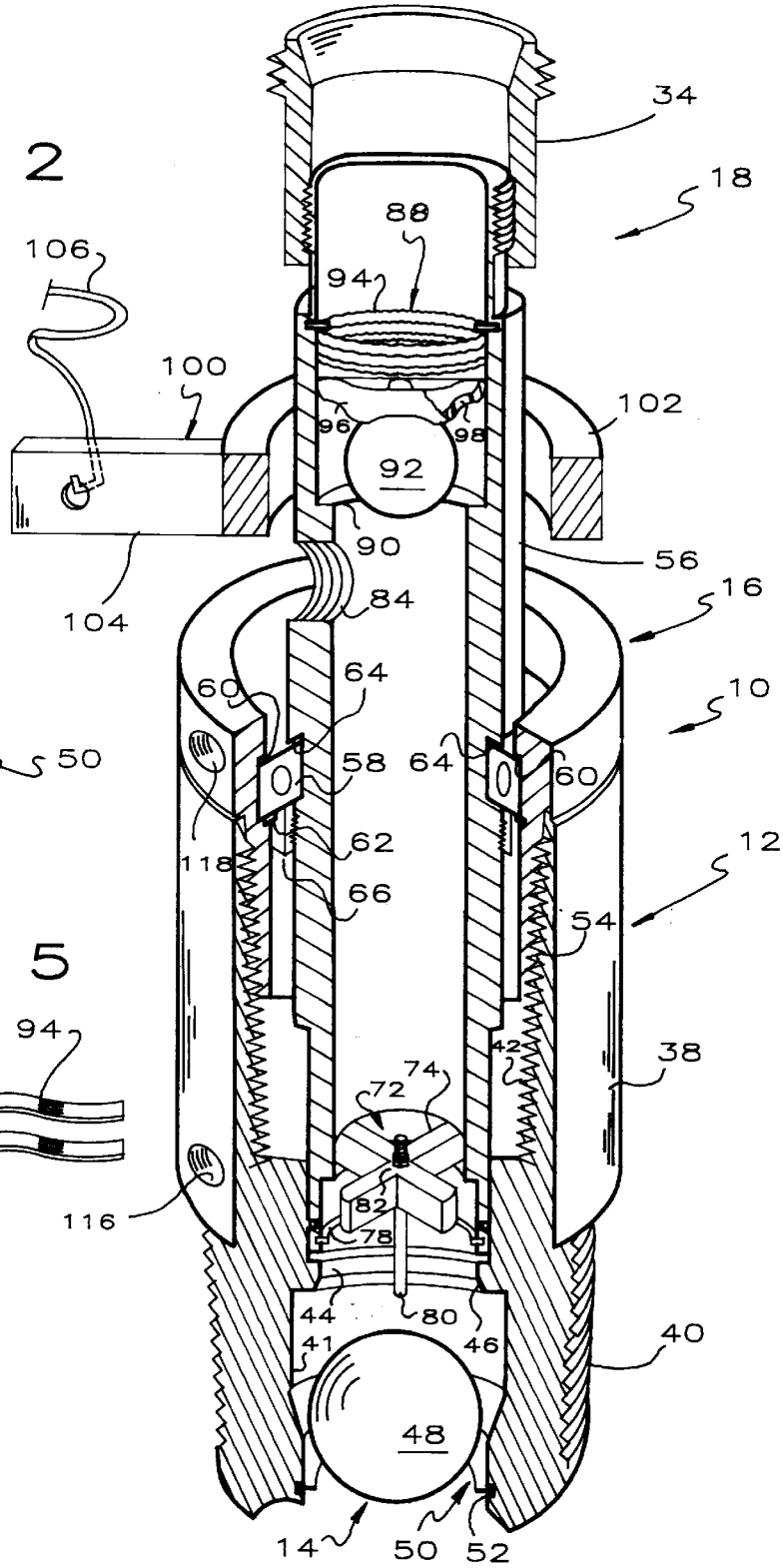
FIG. 2 is an enlarged partially broken isometric view of the safety sub of this invention.

As shown best in FIGS. 2 and 3, the lower end of the mandrel 56 is of somewhat reduced diameter and provides a groove receiving an O-ring 68 for sealing against a passage or cylindrical wall 70 at a location immediately above the shoulder 44. An assembly 72 on the lower end of the mandrel 56 normally holds the ball 48 away from the seat 46 and thereby allows upward flow in the safety sub 10. The assembly 72 comprises an X-shaped support 74 held against a shoulder 76 by a split snap-type retaining ring 78 located below the O-ring 68. A threaded rod 80 is captivated to the support 74 by a nut 82 and extends, in a normal position, below the seat 46 thereby keeping the ball 48 in a normal open position.

Closing of the valve 14 is accomplished by unthreading the operator section 16 which raises the sleeve 18 relative to the valve section 12 thereby raising the rod 80 above the valve seat 46 to a valve open position. It will be seen that the O-ring 68 seals against the passage 70 for the entire distance in which the sleeve 18 moves from the valve open position to the valve closed position. It will also be seen that the operator section 16 can be unscrewed entirely from the valve section 12, for purposes more fully apparent hereinafter.

The sleeve 18 includes a threaded opening 84 for receiving a bleed off valve 86 for releasing pressure in the safety sub 10 before unthreading the safety sub 10 from the drill pipe box 32. This prevents any surprising spurt of low pressure drilling mud from escaping.

Figure 5:
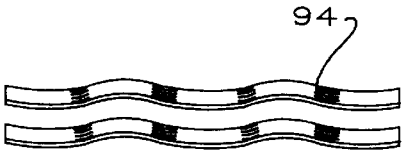
FIG. 5 shows vertically stacked coils of an undulating flat metal spring used to bias a check valve toward a valve closed position.

The upper end of the sleeve 18 provides a check valve assembly 88 allowing low pressure mud to pass into the mud saving system 20 and preventing reverse flow. The check valve assembly 88 preferably includes a seat 90 and a ball check 92 biased toward the closed position by a coiled spring 94 acting against a follower 96 abutting the ball check 92. The coiled spring 94 may be of any suitable type and is illustrated in FIG. 5 as being a flat undulating spring metal band such as is available commercially from Smalley Steel Ring Company of Wheeling, Illinois. The coils of each revolution of the spring 94 are vertically stacked so the undulations react in a desired manner. The follower 96 provides a number of passages 98 allowing fluid flow through the check valve assembly 88.

A support 100 is provided on the exterior of the sleeve 18 for suspending the safety sub 10 from the travelling block of the drilling rig. The support 100 comprises a collar 102 of a size that will not pass the union half 34 and provides an arm 104 for connection to a spring 106 or other counterbalance hanging on the travelling block (not shown).

Figure 4:
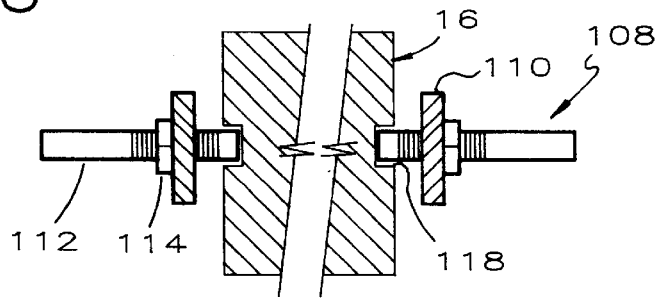
FIG. 4 is a enlarged partial cross-sectional view of the wrench shown in FIG. 2 showing its connection to the operator section of the safety sub.

As shown in FIGS. 1 and 4, a wrench 108 is normally attached to the safety sub 10, and is preferably normally attached to the valve section 12. The wrench 108 includes a ring 110 having an inside diameter sufficient to receive the safety sub 10 and a pair of opposed handles 112 adjustably positioned in threaded openings provided by the ring 110. Conveniently, the handles 112 are threaded into nuts 114 welded to the ring 110. As shown in FIGS. 1 and 2, the handles 112 extend into blind openings 116 in the body 38 of the valve section 12.

The safety sub 10 is normally hand tightened by the derrickman to the box 32 of the uppermost drill pipe joint. When high pressure flow inside the safety sub 10 is sensed, the floor hands use the wrench 108 to tighten the valve section 12 to the box 32 of the uppermost drill pipe joint. The handles 112 are then backed out of the blind unthreaded passages 116 and the wrench 108 raised to a pair of blind unthreaded passages 118 in the operator section 16. The handles 112 are then threadably advanced through the nuts 114 and the operator section 16 is unthreaded or backed off to raise the pin 80 and allow the ball check 48 to close.

Operation of the safety sub 10 of this invention should now be apparent. The safety sub 10 is suspended from the travelling block of the drilling rig by the spring 106 so the weight of the safety sub 10 is easily handled by the derrickman. After a drill pipe stand is latched in the rig elevators (not shown), the safety sub 10 is threaded by the derrickman, using only the hands, into the box 32 of the uppermost drill pipe joint. The drill pipe stand is lowered by the driller into the hole and the slips (not shown) set. Any low pressure mud flowing upwardly out of the drill pipe passes through the safety sub 10 into the mud saving system 20. When low pressure flow ceases, or substantially ceases, the bleed off valve 86 is opened to relieve any residual pressure while the check valve assembly 88 prevents any reverse flow of drilling mud from the hose 24. The floor hands then unscrew the safety sub 10 and the driller raises the travelling block to the derrickman to repeat the cycle. The only difference in operation of the safety sub 10 in a low pressure operation is that standard mud saving nipples or pins do not have a check valve analogous to the check valve 88 nor do they all have a bleed off valve analogous to the valve 86.

If the well starts to kick, high pressure flow is sensed in the safety sub 10, which should normally occur after the slips (not shown) are set. The floor hands first use the wrench 108 to tighten the valve section 12 in the upper drill pipe box 32. The handles 112 are then backed off, the wrench raised to the openings 118 and the handles 112 threadably advanced until the ends are well received in the openings 118. The wrench 108 is then used to back off, or unthread, the operator section 16. This causes the sleeve 18 to rise thereby raising the rod 80. Eventually, the rod 80 rises above the seat 46 and the ball check 48 closes against the seat 46 thereby stopping flow in the safety sub 10.

Continued unthreading of the operator section 16 causes the O-ring 68 to rise out of the passage 70 and the operator section 16 unthreads from the valve section 12, thereby exposing the coarse drill pipe threads 42. The operator section 16 and the sleeve 18 are set aside. The kelly (not shown) or top drive unit (not shown) is threaded directly into the coarse drill pipe threads 42 and conventional measures are taken to control the kick.

An important feature of the safety sub 10 is that the retaining ring 50 is made to release the ball check 48 and pass downwardly out of the valve section 12. This clears the axial passage through the valve section 12 allowing wire line operations through the valve section and avoids large pressure losses in the valve section 12. This can be important in a situation where the liner or washpipe has become stuck in the hole and cannot be removed by circulation and/or chemicals added to the drilling mud. In this circumstance, a free point indicator is run into the hole on a wire line and the point where the pipe is stuck is determined. The pipe is then shot off above the stuck point and the freed pipe removed from the hole.

This ability can be extremely valuable because, in every liner operation and in most situations where wash pipe is in the hole, the stuck point will be below protective pipe cemented in the well. Having the ability to locate the stuck point means that the pipe can be shot off well below the bottom of the liner which means that sidetracking the well can be done in the open hole rather than having to cut a window in the protective pipe at a location above where it was originally thought that protection pipe was needed.

Figure 6:
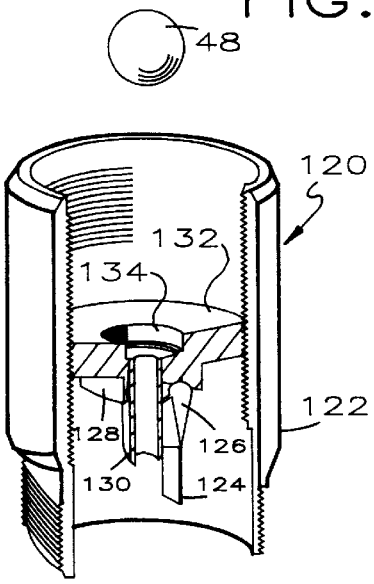
FIG. 6 is a cross-sectional view of a conventional cement float shoe that can be used with this invention.

Another feature of this invention is shown in FIG. 6. In most liner cementing operations, float equipment 120 which may be either in the form of a collar illustrated in FIG. 6 or a float shoe is run on or near the bottom of the liner. Fill-up float equipment 120 allows drilling mud to pass and enter the liner. A typical float collar 120, such as made by Weatherford-Gemoco of Houma, Louisiana includes a body 122, a flapper type check valve 124 hinged about a pivot 126 and biased by a spring (not shown) toward a closed position abutting a valve seat 128. The flapper valve 124 is held in a valve open position by any suitable mechanism, such as a sleeve 130 pressed into an apertured plate 132. After the liner is on bottom and at the start of normal cementing operations, a ball is dropped through the liner to dislodge or break the abutment 130 so the flapper 124 closes. The ball passes through a central opening 134 and exits through the bottom of the float equipment 120. After cement is pumped through the liner and into the annulus between the liner and the open hole, pump pressure is reduced. The pumped cement tends to flow backwardly through the float equipment 120 and is prevented from doing so by the flapper valve 124. Those skilled in the art will recognize operation of the float equipment 120 to be conventional.

In this invention, if there is a high pressure kick when running a liner into the well, it may be decided to cement the liner in place. This can be accomplished because the ball check 48 is sized to operate the float equipment 120. Thus, the ball check 48 is pumped downwardly into the drill pipe string 30 and into the liner so it displaces the sleeve 130 or otherwise enables the flapper valve 124 to close. This allows cementing operations to be conducted in a conventional manner.

It will be apparent that the lower valve section 12 can be used as an inside blow out preventer simply by stabbing the threads 40 into the box of an uppermost drill pipe joint suspended in the slips (not shown) of a drilling rig.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

We claim:

1. A process of running large diameter pipe into a well using a drilling rig having a mud system and a derrick, the large diameter pipe being on the bottom of smaller diameter pipe having an axial flow path therethrough, comprising attaching a safety sub to an upper threaded connection of a joint of the smaller diameter pipe upright in the derrick, the safety sub including a flexible hose connected to the mud system of the rig, a valve section attached to the upper threaded connection of the smaller diameter pipe and having a valve element movable to preventing upward flow in the smaller diameter pipe, and an operator section removably attached to the valve section normally holding the valve element in a position allowing upward flow in the small diameter pipe, then running the joint of the smaller diameter pipe into the well, then in response to a low pressure mud flow upwardly in the smaller diameter pipe, diverting the low pressure mud flow through the safety sub and flexible hose into the mud system, and in response to a high pressure mud flow upwardly in the smaller diameter pipe, manipulating the safety sub and closing the axial flow path against upward flow therethrough whereby a kick may be controlled, after the axial flow path is closed, removing the operator section and exposing a connection to the valve section, then attaching a source of pressure to the valve section connection, and then opening the axial flow path for downward fluid flow into the smaller diameter pipe and pumping high pressure weighted liquid through the valve section, through the smaller diameter pipe and through the large diameter pipe into the well, clearing the axial flow path by pumping the valve element downwardly out of the safety sub into the smaller diameter pipe.

2. The process of claim 1 wherein the smaller diameter pipe is drill pipe.

3. The process of claim 2 conducted in the course of a cementing operation wherein the large diameter pipe is a liner.

4. The process of claim 2 conducted in the course of a fishing operation and wherein the large diameter pipe is wash pipe.

5. The process of claim 1 further comprising, after the valve element is pumped downwardly out of the safety sub into the smaller diameter pipe, running a wire line tool through the valve section into the smaller diameter pipe.

6. The process of claim 1 wherein the valve element is a ball check and the safety sub includes a seat for engaging the ball check and preventing upward flow in the safety sub, means for normally holding the ball away from the seat and allowing upward flow in the safety sub and a retainer for limiting movement of the ball check away from the seat and the step of closing the axial flow path against upward flow comprises manipulating the holding means and allowing the ball to sealably engage the seat.

7. The process of claim 6 wherein the step of clearing the axial flow path comprises manipulating the retainer and allowing the ball to move out of the safety sub.

8. The process of claim 7 wherein the retainer comprises an expansible retaining ring normally holding the ball against downward movement out of the safety sub and expansible in response to pressure induced forces acting on the ball to release the ball for downward movement out of the safety sub.

9. The process of claim 1 wherein the step of attaching the safety sub to the upper threaded connection of a joint of the smaller diameter pipe comprises threading the safety sub into the upper box hand tight and the step of manipulating the safety sub and closing the axial flow path against upward flow comprises tightening a lower section of the safety sub in the upper box with a wrench carried by the safety sub.

10. The process of claim 9 wherein the wrench is carried on the lower section of the safety sub and the step of manipulating the safety sub comprises, after tightening the lower section of the safety sub with the wrench, removing the wrench from the lower section of the safety sub, installing the wrench on an upper section of the safety sub and closing the axial flow path by using the wrench and turning the upper section of the safety sub.

11. The process of claim 1 wherein the large diameter pipe is a liner and the smaller diameter pipe is drill pipe, the liner having a float shoe on the bottom thereof having a check valve arranged to prevent flow into the liner and means for holding the check valve in an open position allowing flow into the liner, the axial flow path is obstructed by a valve element and further comprising clearing the axial flow path by pumping the valve element downwardly into the smaller diameter pipe and pumping the valve element into the float shoe and disabling the holding means whereby the check valve may close and prevent flow into the liner so normal cementing operations may be conducted.

12. The process of claim 1 wherein the large diameter pipe has a larger internal diameter than the internal diameter of the smaller diameter pipe.

13. The process of claim 1 wherein the large diameter pipe has a larger outer diameter than the outer diameter of the smaller diameter pipe.

14. An apparatus for diverting mud and controlling a kick when running in a well with large diameter pipe on the bottom of smaller diameter pipe, comprising a safety sub having a lower valve section providing an axial flow path, a threaded connection for securement to a box of a joint of the smaller diameter pipe, and a normally open valve for closing the axial flow path;

an upper operator section threadably received in the lower section including means for closing the normally open valve so that high pressure flow from the well can be stopped by manipulation of the upper operator section, the upper operator section being removable from the lower section after the valve is closed so that a source of pressure may be connected to the lower section; and a sleeve mounted on the upper operator section for rotation relative to the upper operator section and open to the axial flow path providing a flow path into and out of the well whereby the sleeve may be connected to a mud system of a drilling rig for saving mud flowing upwardly in the smaller diameter pipe.

15. The apparatus of claim 14 further comprising a mud saving system including a flexible hose secured to the sleeve for connection to the mud system and a check valve allowing flow through the sleeve and flexible hose toward the mud system and preventing flow from the flexible hose toward the axial flow path so that low pressure mud flowing upwardly through the safety sub is diverted to the mud system without backflowing through the flexible hose.

16. The apparatus of claim 14 wherein the upper operator section includes means for moving the normally open valve to the closed position in response to unthreading movement of the upper operator section relative to the lower valve section.

17. The apparatus of claim 14 further comprising a first wrench connection on the lower valve section, a second wrench connection on the upper operator section and a wrench, normally removably connected to the first wrench connection, so workmen can first tighten a connection between the valve section and the smaller diameter pipe and then move the wrench to the upper operator section for manipulating the valve.

18. The apparatus of claim 14 wherein the normally open valve comprises a valve seat, a ball check mounted for movement in response to upward flow in the lower valve section for sealing against the valve seat and a releasable retainer restraining the ball check against movement downwardly out of the lower valve section whereby the ball check can be pumped out of the lower valve section by pumping into the lower valve section.

19. The apparatus of claim 14 further comprising means for suspending the apparatus from a travelling block of the rig.

20. An apparatus for diverting low pressure mud and controlling a high pressure kick when running in a well with large diameter pipe on the bottom of smaller diameter pipe using a rig having a mud system, comprising a lower section providing an axial flow passage, a lower threaded connection for securement to a joint of the smaller diameter pipe, and a normally open valve for normally allowing upward flow through the axial flow passage and closeable for preventing upward flow through the axial flow passage;

an operator section threadably received in the lower section including means for moving the valve to a closed position in response to unthreading of the operator section relative to the lower section so that high pressure flow from the well can be stopped by manipulation of the operator section; and a sleeve mounted for rotation relative to the operator section and open to the axial flow passage providing a flow path into and out of the well for connection to a flexible hose of a mud saving system so low pressure mud is normally diverted to the mud system.

21. The apparatus of claim 20 further comprising a check valve for allowing flow through the sleeve and flexible hose toward the mud system and preventing flow from the flexible hose toward the axial flow path so that any mud flowing upwardly through the safety sub is diverted to the mud system without backflowing through the flexible hose.

22. The apparatus of claim 20 wherein the normally open valve comprises a valve seat, a ball check mounted for movement in response to upward flow in the lower section for sealing against the valve seat and a releasable retainer restraining the ball check against movement downwardly out of the lower section whereby the ball check can be pumped out of the lower section by pumping into the lower section.

23. The apparatus of claim 20 further comprising a valve opening through the sleeve for bleeding of residual pressure in the sleeve after low pressure mud flow through the sleeve.

24. An apparatus for controlling a high pressure flow coming up the inside of a string of pipe, comprising a lower section providing an axial flow passage, a lower threaded connection for securement to a threaded connection of a joint of the pipe string, and a normally open check valve including a ball check and a seat for normally allowing upward flow through the axial flow passage and closeable for preventing upward flow through the axial flow passage;

an operator section operatively connected to the lower section including an abutment for holding the ball check away from the seat and means for moving the abutment away from the ball check so flow from the well can be stopped by manipulation of the operator section; and means for normally retaining the ball check in the lower section and, in response to pressure induced forces on the ball check, releasing the ball check for downward movement into the pipe string so wire line operations may be conducted through the lower section after removal of the operator section.

25. The apparatus of claim 24 wherein the lower section provides a groove below the ball check and the retaining means comprises at least one expansible retaining ring in the groove, the expansible retaining ring having an unstressed inside diameter less than the ball check and being expandable, upon the application of pressure forces to the ball check, to an inside diameter at least as large as the ball check whereby the ball check is retained in the lower section until pump pressure is applied.

26. The apparatus of claim 24 wherein the operator section is threadably connected to the lower section and wherein the operator section includes means for moving the abutment away from the ball check in response to unthreading movement of the operator section relative to the lower section.

27. An apparatus for controlling a high pressure flow coming up the inside of a string of pipe, comprising a housing providing an axial flow passage, a lower threaded connection for securement to a joint of the pipe string, and a check valve including a ball check and a seat, the ball check being closeable against the seat in response to upward flow in the axial flow passage thereby preventing upward flow through the axial flow passage; and means for normally retaining the ball check in the housing and, in response to forces on the ball check acting axially downwardly, releasing the ball check for downward movement into the pipe string so wire line operations may be conducted through the housing.

28. The apparatus of claim 27 wherein the housing provides a groove below the ball check and the retaining means comprises at least one expansible retaining ring in the groove, the expansible retaining ring having an unstressed inside diameter less than the ball check and being expandable, upon the application of axial forces to the ball check, to an inside diameter at least as large as the ball check whereby the ball check is retained in the housing until the axial forces are applied.

* * * * *